US008733644B2

(12) United States Patent
Hirono et al.

(10) Patent No.: US 8,733,644 B2
(45) Date of Patent: May 27, 2014

(54) SELF-CHECHOUT APPARATUS

(75) Inventors: Masato Hirono, Shizuoka-ken (JP); Toshiyasu Terahara, Shizuoka-ken (JP); Yuki Kawaguchi, Shizuoka-ken (JP); Masaru Murakoshi, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/568,246

(22) Filed: Aug. 7, 2012

(65) Prior Publication Data

US 2013/0043307 A1 Feb. 21, 2013

(30) Foreign Application Priority Data

Aug. 19, 2011 (JP) ..... 2011-179786

(51) Int. Cl.

| | |
|---|---|
| ***G06K 15/00*** | (2006.01) |
| ***G06F 17/00*** | (2006.01) |
| ***G06Q 20/00*** | (2012.01) |
| ***A63F 9/02*** | (2006.01) |

(52) U.S. Cl.

USPC ..... 235/383; 235/375; 186/59; 186/61; 705/16; 705/17; 705/23

(58) Field of Classification Search

USPC ..... 235/375, 383, 462.01–462.49; 705/16–17, 23; 186/59, 61

See application file for complete search history.

(56) References Cited

U.S. PATENT DOCUMENTS

| | | | | |
|---|---|---|---|---|
| 5,543,607 | A | 8/1996 | Watanabe et al. | |
| 5,818,528 | A * | 10/1998 | Roth et al. | 348/364 |
| 2011/0080268 | A1 * | 4/2011 | Kaneko | 340/10.4 |

FOREIGN PATENT DOCUMENTS

| | | |
|---|---|---|
| JP | 04-055997 | 2/1992 |
| JP | 2007-226498 | 9/2007 |
| JP | 2010-055324 | 3/2010 |
| JP | 2011-055324 | 3/2010 |
| JP | 2011-081619 | 4/2011 |

OTHER PUBLICATIONS

Japanese Office Action for Japanese Patent Application No. 2011-179786 mailed on Jun. 11, 2013.

* cited by examiner

*Primary Examiner* — Michael G Lee
*Assistant Examiner* — Laura Gudorf
(74) *Attorney, Agent, or Firm* — Amin, Turocy & Watson, LLP

(57) ABSTRACT

In accordance with one embodiment, a self-checkout apparatus comprises a structural body including a first photographing unit which is provided with a first photographing window at the front part thereof. The first photographing unit has a photographing area in front of the first photographing window through which the first photographing unit photographs a computer readable symbol located within the photographing area. The apparatus also comprises a portable second photographing unit configured to photograph the computer readable symbol and a cradle, arranged at a position adjacent to one side of the structural body, on which the second photographing unit is placed.

2 Claims, 7 Drawing Sheets

SELF-CHECHOUT APPARATUS

CROSS-REFERENCE TO RELATED APPLICATION

This application is based upon and claims the benefit of priority from Japanese Patent Application No. 2011-179786, filed Aug. 19, 2011, the entire contents of which are incorporated herein by reference.

FIELD

Embodiment described herein relates to a self-checkout apparatus.

BACKGROUND

Conventionally, a self-checkout terminal is well known which is installed in retail stores, such as a supermarket, etc., to read a commodity code by photographing the code according to the customer's operation and to carry out a checkout processing using the code which is read out.

DETAILED DESCRIPTION

Figure 1:
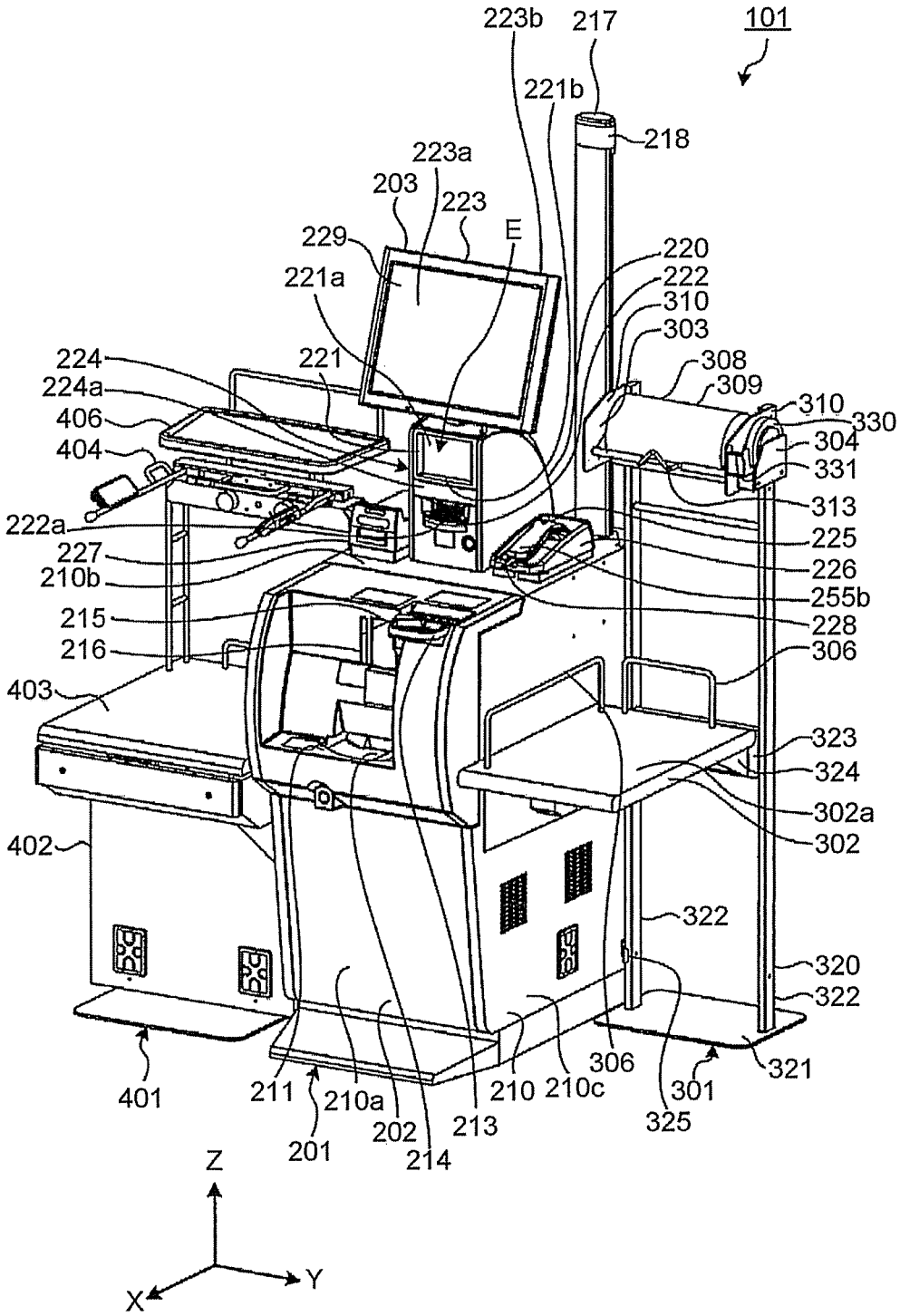
FIG. 1 is a perspective view of a self-checkout terminal according to an embodiment.

In accordance with one embodiment, a self-checkout apparatus comprises a structural body including a first photographing unit which is provided with a first photographing window at the front part thereof. The first photographing unit has a photographing area in front of the first photographing window through which the first photographing unit photographs a computer readable symbol located within the photographing area. The apparatus also comprises a portable second photographing unit configured to photograph the computer readable symbol and a cradle, arranged at a position adjacent to one side of the structural body, on which the second photographing unit is placed.

An embodiment of the present invention is described in detail below with reference to the accompanying drawings. This embodiment is an example of the application of a self-checkout apparatus, such as a self-checkout terminal 101. Moreover, in each accompanying drawing, the front in the front-back direction of the self-checkout terminal 101 is set to be the direction X, the width direction of the self-checkout terminal 101 is set to be the direction Y, and the height direction of the self-checkout terminal 101 is set to be the direction Z.

As shown in FIG. 1-FIG. 4, the self-checkout terminal 101 described in this embodiment includes a settlement terminal 201 serving as a base, a basket placing unit 301 arranged at one of the sides of the settlement terminal 201 and a weighing device 401 arranged at the other side of the settlement terminal 201.

The settlement terminal 201 includes a platform section 202 arranged on the floor surface and an input/output section 203 vertically arranged on the upper surface of the platform section 202.

The platform section 202 includes a first housing 210, a depositing and dispensing device 211 arranged on the first housing 210 and an information processing device (not shown) arranged in the first housing 210. The first housing 210 is substantially formed in a cubic shape. The coin depositing port 213, the coin dispensing port 214, the bill depositing port 215 and the bill dispensing port 216 of the depositing and dispensing device 211 are arranged on the front side 210*a* of the first housing 210. The mechanism unit of the depositing and dispensing device 211 is arranged in the first housing 210.

By the operations of the mechanism unit, the depositing and dispensing device 211 accommodates coins input from the coin depositing port 213 and bills input from the bill depositing port 215 according to denomination and dispenses change from the coin dispensing port 214 or bill dispensing port 216 in response to an instruction from the information processing device.

The information processing device is a control section for controlling each section of the self-checkout terminal 101.

A display pole 217 is vertically arranged at the back of the platform section 202 to display the current status (normal state or fault state) of the self-checkout terminal 101. The top end part of the display pole 217 is provided with a lighting section 218 which selectively radiates blue light and red light.

The input/output section 203 includes a second housing 220, a first photographing unit 221 and a receipt printer 222 arranged in the second housing 220 and a display 223 arranged at the upper end part of the second housing 220.

The second housing 220, the first photographing unit 221 and the receipt printer 222 together constitute a structural body 224, which is arranged on the upper surface 210*b* (the upper surface of the platform section 202) of the first housing 210. The structural body 224 is located at the center of the upper surface 210*b* of the first housing 210 in the width direction (direction Y). The first photographing window 221*a* of the first photographing unit 221 and the receipt issuing port 222*a* of the receipt printer 222 are arranged on the front side 224*a* (the front wall of the second housing 220) of the structural body 224 along the vertical direction. The receipt issuing port 222*a* is located below the first photographing window 221*a*. Thus, the structural body 224 extends upwards from the upper surface 210*b* of the first housing 210, with the first photographing window 210*a* arranged thereon and a display 223 arranged at the upper end part thereof.

The first photographing unit 221 is a still (fixed) scanner which optically reads a commodity code printed on a commodity as a computer readable symbol, such as, a barcode and a two dimensional code. The first photographing unit 221 includes a part (the upper part) of the second housing 220, and the first photographing window 221*a* is arranged on the front side 224*a* (the front wall of the second housing 220) of the structural body 224. That is, the front side 224*a* of the structural body 224 constitutes the front side of the first photographing unit 221. The first photographing unit 221 includes an area photographing element (not shown), such as a CCD (Charge Coupled Device), which is arranged in the second housing 220 and takes the area in front of the first photographing window 221*a* as a photographing area E. The first photographing unit 221 photographs the image of a code symbol, for example, a barcode, printed on a commodity with the area photographing element and decodes the photographed image to acquire the code data (commodity code) of the code symbol. The first photographing unit 221 outputs the acquired code data to the information processing device.

The receipt printer 222 includes a part (the lower part) of the second housing 220, and the receipt issuing port 222*a* is arranged at the front side 224*a* (the front wall of the second housing 220) of the structural body 224. The receipt printer 222 also includes a printing mechanism (not shown) arranged in the second housing 220. Under the control of the information processing device, the receipt printer 222 issues the receipt printed by the printing mechanism from the receipt issuing port 222*a*.

The display 223 is, for example, a liquid crystal display which displays various kinds of information under the control of the information processing device. Moreover, a touch panel 229, which functions as an information input unit, is arranged on the display panel 223*a* of the display 223. The display 223 has an extension part 223*b* extending towards a side of the structural body 224.

A portable second photographing unit 225 and a cradle 226 for placing the second photographing unit 225 are arranged on one side of the structural body 224. On the other hand, a card reader 227 is arranged on the other side of the structural body 224 to read and write information from and to a magnetic card (information recording medium) such as a point card or credit card.

The second photographing unit 225 is a portable handheld scanner which optically reads the commodity code that is printed on a commodity as a barcode. A curved third housing 225*b* provided with a second photographing window 225*c* is arranged at one end (front end) of the second photographing unit 225. A curl cord 228 is connected with the other end 225*d* (the base end) of the second photographing unit 225 to serve as an electric wire. The second photographing unit 225 includes an area photographing device (not shown) , such as a CCD (Charge Coupled Device) camera, which is arranged in the third housing 225*b* and takes the area in front of the second photographing window 221*a* as a photographing area. The second photographing unit 225 photographs the image of the code symbol (e.g. barcode) printed on a commodity held in the photographing area with the area photographing device and decodes the photographed image to acquire the code data (e.g. commodity code) of the code symbol. The second photographing unit 225 outputs the acquired code data to the information processing device through the curl cord 228. The curl cord 228 is partially eliminated for the purpose of simplicity in FIG. 1-FIG. 5.

The second photographing unit 225 can be placed on or taken out of the cradle 226. The cradle 226 supports the second photographing unit 225 in a state that the other end 225*d* of the second photographing unit positions in front of the one end 225*a* thereof.

Figure 6:
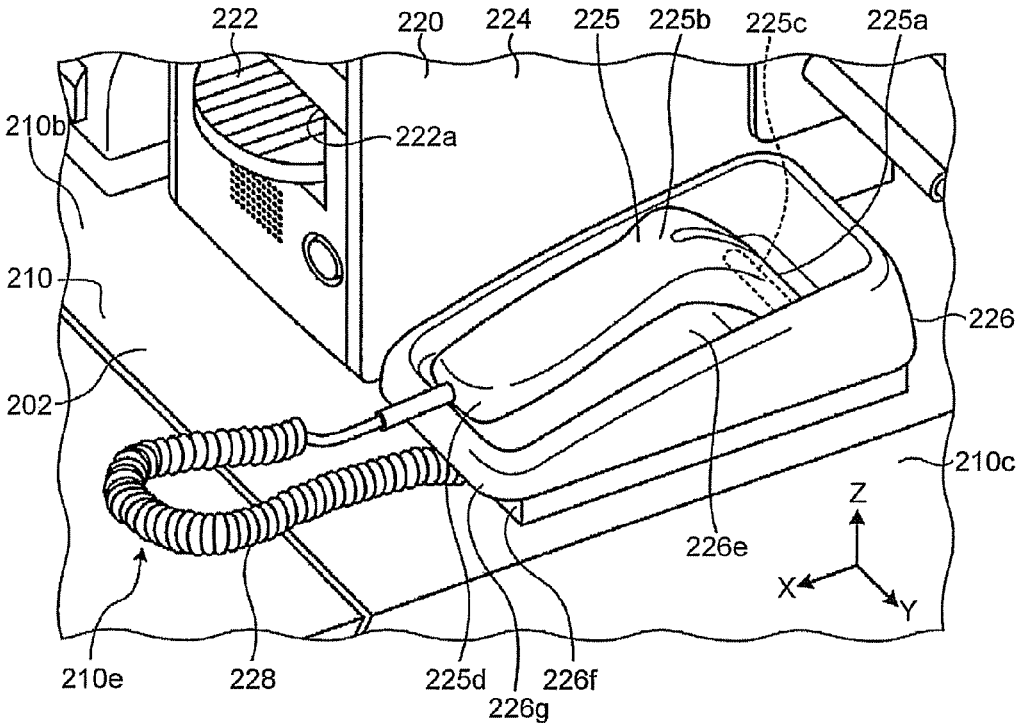
FIG. 6 is a perspective view illustrating a state in which a second photographing unit carried is placed on a tray according to the embodiment.

As shown in FIG. 6, the tray 226 is arranged adjacent to the one side of the structural body 224. Specifically, the cradle 226 is arranged on the upper surface 210*b* of the first housing 210 between the extension part 223*b* of the display 223 and the upper surface 210*b* of the first housing 210 serving as the upper surface of the platform section 202, and is opposite to the structural body 224 in the width direction (Y direction) of the structural body 224 (refer to FIG. 1). The second photographing unit 225 placed on the cradle 226 is located at a position lower than the receipt issuing port 22*a* (refer to FIG. 2) and is arranged in parallel to the structural body 224 provided with the first photographing unit 221 (refer to FIG. 2).

Figure 7:
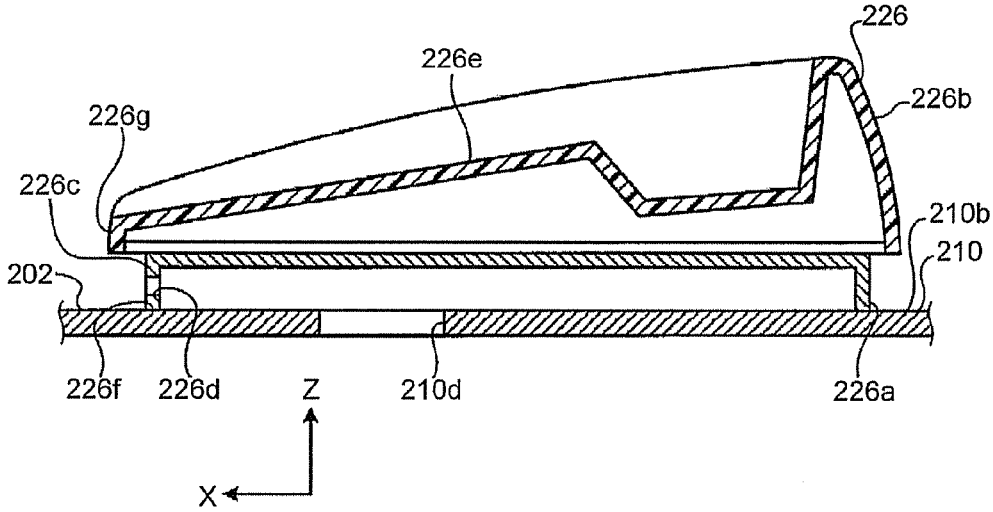
FIG. 7 is a side view of the tray in the longitudinal section according to the embodiment.

As shown in FIG. 7, the cradle 226 specifically includes a pedestal 226*a* and a cradle body 226*b* fixed on the upper part of the pedestal 226*a*. The pedestal 226*a*, which is formed in a rectangular prism shape with an opened bottom side, is fixed on the upper surface 210*b* of the first housing 210. An insertion hole 226*d* for the insertion of the curl cord 228 is formed on the front wall 226*c* of the pedestal 226*a*. Here, an insertion hole 210*d* for the insertion of the curl cord 228 is arranged on the upper surface 210*b* of the first housing 210 (the upper surface of the platform section) and is located under the cradle 226. The curl cord 228 extending from the other end 225*d* of the second photographing unit 225 is led into the first housing 210 through the insertion holes 226*d* and 210*d* and then connected with the information processing device. The curl cord 228 extends forwards from the front part 226*f* of the cradle 226. A concave part 226*e* is formed on the upper surface of the cradle body 226*b* to accommodate the second photographing unit 225. The bottom surface of the concave part 226*e* follows the curved shape of the second photographing unit 225. A part of the cradle body 226*b* forms an extension part 226*g* extending forwards from the pedestal 226*a*, and a part of the curl cord 228 is arranged below the extension part 226*g*.

Here, a curl cord accommodation section 210*e* for accommodating the curl cord 228 is arranged on the upper surface 210*b* of the first housing 210 (the upper surface of the platform section).

The basket placing unit 301 includes a basket placing section 302, a bag holder section 303 and an adhesive tape holder 304.

The basket placing section 302 is arranged on one side of the settlement terminal 201 to place a basket (FIG. 5) in which the commodities that are not photographed by the first photographing unit 221 are accommodated. The basket placing section 302 formed in a plate shape places the basket 305 on the upper surface 302*a* thereof . A barrier member 306 is arranged on part of the periphery of the upper surface 302*a*. The basket placing section 302 is fixed on the one side of the first housing 210 of the platform section 202 via a pair of front and rear coupling members 307. The coupling members 307 are fixed on both the one side 210*c* of the first housing 210 and the lower surface of the basket placing section 302.

The bag holder section 303 is used to hold a bag 308, which can be exemplarily a plastic bag, which is also called a bag for accommodating a package containing a commodity with liquid. Specifically, the bag holder section 303 holds a rolled body 309 consisting of a plurality of bags 308. The rolled body 309, which is referred to as a poly roll type, is formed by winding a sheet consisting of a plurality of bags 308 connected in line. Perforation line (a predetermined cutoff section), at which the bags 308 can be separated from each other, are formed at the mutually connection part of the bags 308. Moreover, the bag 308 may be of the called poly-tissue type.

Figure 8:
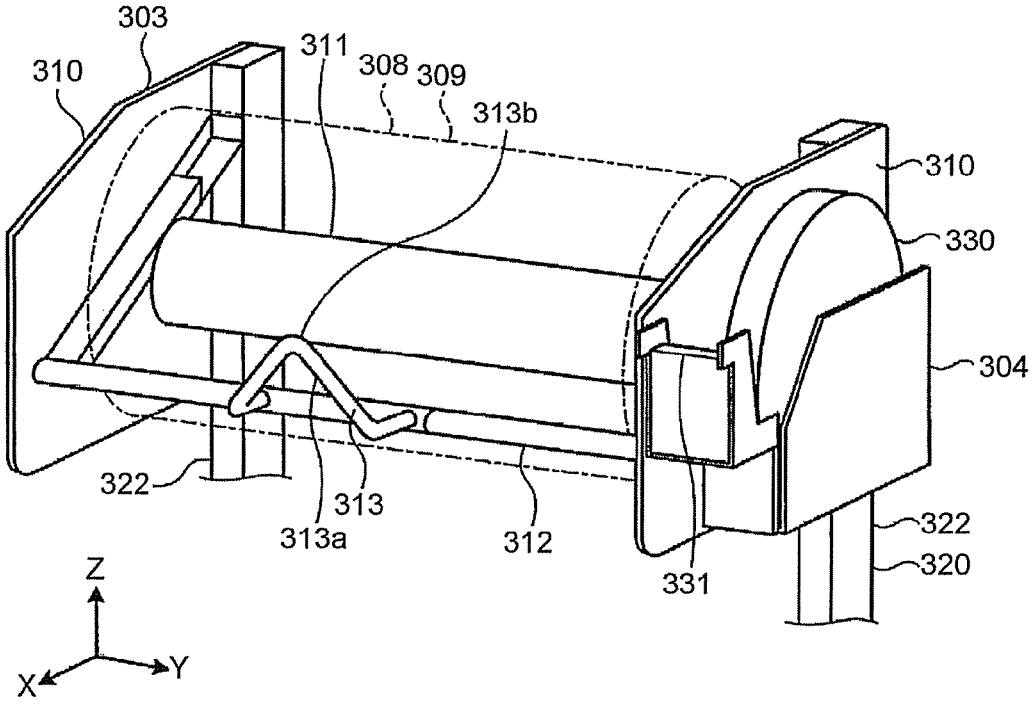
FIG. 8 is a perspective view of a bag holder section and an adhesive tape holder according to the embodiment.

As shown in FIG. 8, the bag holder section 303 includes a pair of side plates 310 and a support shaft 311 bridged between the pair of plates 310. The support shaft 311 is inserted into the insertion hole in the center of the rolled body 309 to support the rolled body 309 rotationally and detachably connected with the pair of plates 310. Moreover, a rod-shaped member 312 is arranged in front of the support shaft 311 of the pair of plates 310. A cutoff section 313, which serves as a takeout section, is arranged in the center of the rod-shaped member 312 in an integrated manner. The cutoff section 313 is located in front of the rolled body 309 supported by the support shaft 311. The cut off section 313 is provided to the bag holder section 303 at a position upper than the lower end 221*b* of the first photographing window 221*a*. The cutoff section 313, which is formed by bending a rod-shaped material, extends forwards from the front end of the rod-shaped member 312. The cut off section 313 has a protrusion portion 313*a* which protrudes upwards to take an inverse V shape. In a state in which the perforation line between bags 308 pulled out of the rolled body 309 contacts with the top 313*b* of the protrusion portion 313*a*, the bags 308 are separated along the perforation line by the protrusion portion 313*a* if a portion of the bag 308 is pulled downwards. In this way, bags 308 holded by the bag holder section 303 may be taken out (separated) along the cutoff section 313 one by one, and the cut off section 313 specifies the position where the bag 308 is taken out of the bag holder section 303. That is, the top 313*b* of the cutoff section 313 indicates the position where the bag 308 is taken out of the bag holder section 303.

Figure 2:
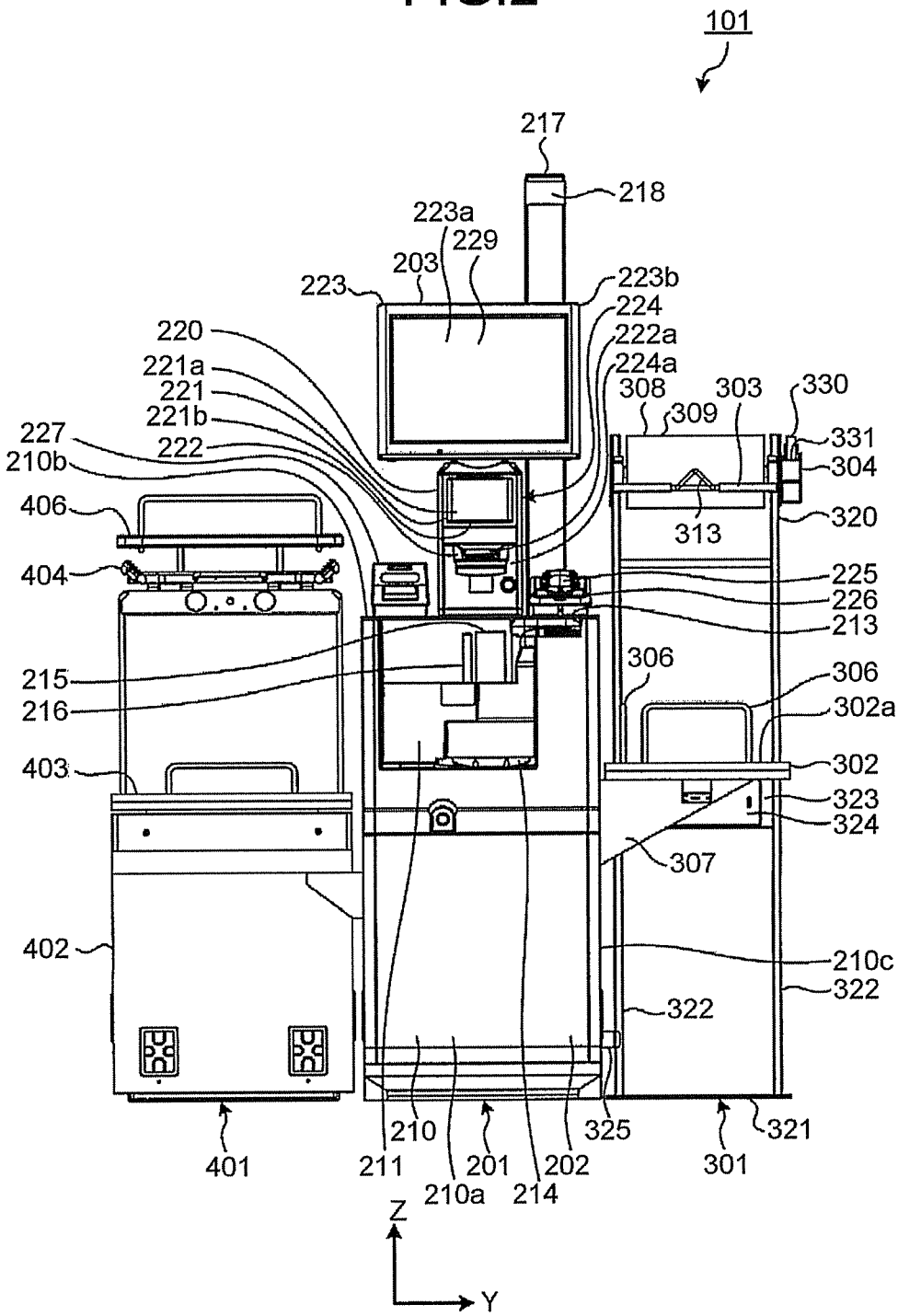
FIG. 2 is a front view of the self-checkout terminal shown in FIG. 1.
Figure 3:
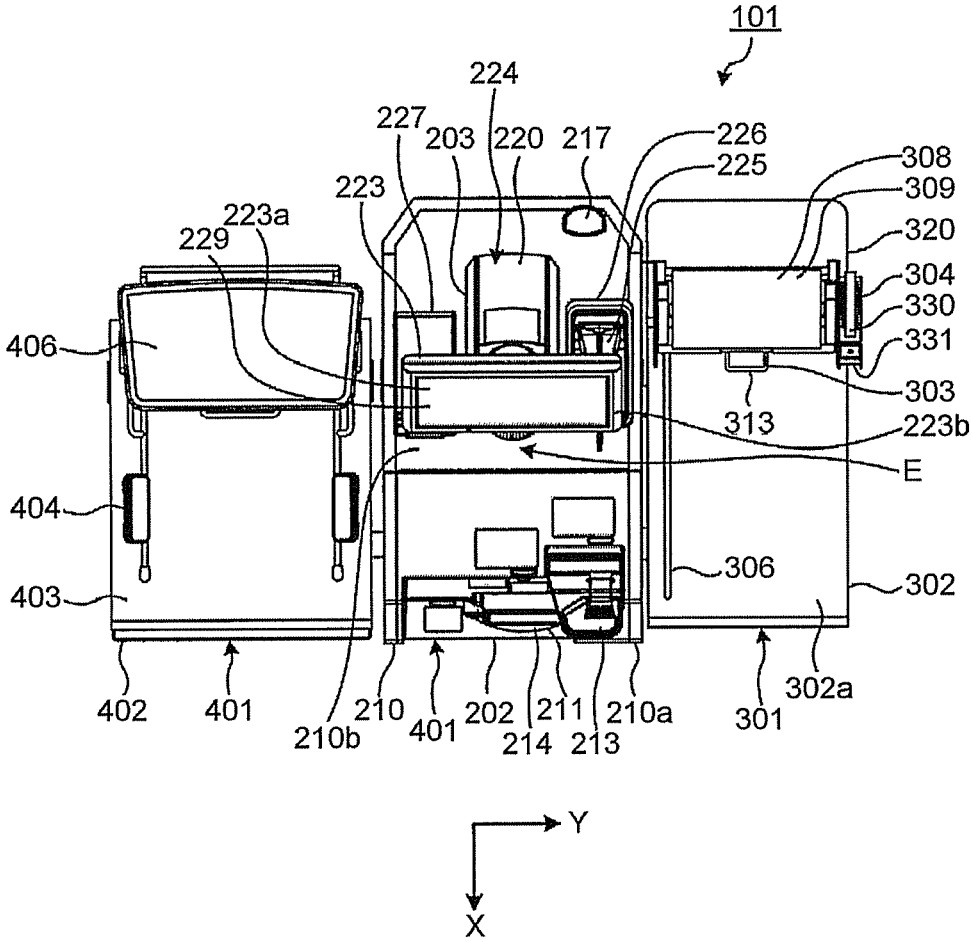
FIG. 3 is a plane view of the self-checkout terminal shown in FIG. 1.
Figure 4:
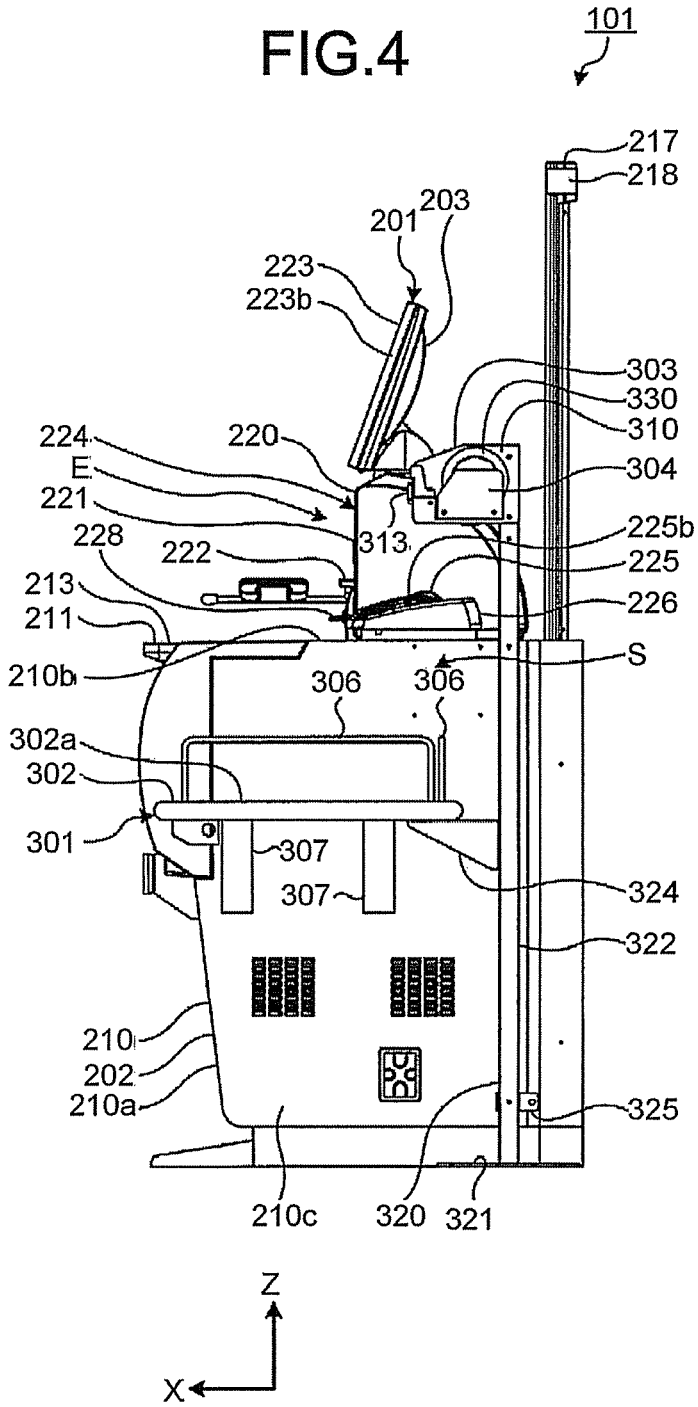
FIG. 4 is a side view of the self-checkout terminal shown in FIG. 1.
Figure 5:
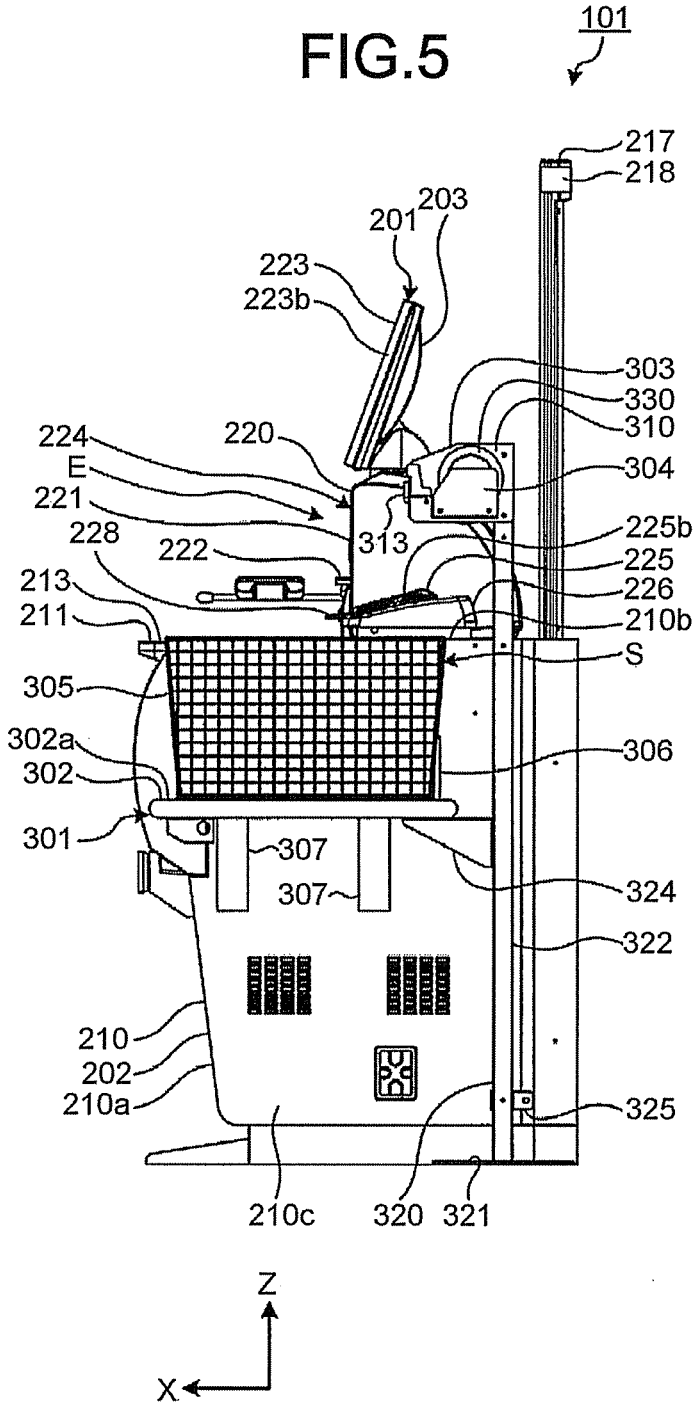
FIG. 5 is a side view of the self-checkout terminal shown in FIG. 1, wherein a basket is placed on the basket placing section of the self-checkout terminal.

The bag holder section 303 is supported by a support section 320. As shown in FIG. 1 and FIG. 2, the support section includes a base plate 321 mounted on the floor, a pair of pole components 322 that are vertically arranged at two horizontal ends of the base plate 321 in the width direction thereof and a connecting plate (connecting component) 323 that connects the middle parts of the pair of pole components 322. The pair of pole components 322 is connected at the rear ends of the pair of plates 310 of the bag holder section 303. The support section 320 is fixed on the platform section 202 of the settlement terminal 201 via the basket placing section 302. Specifically, the connecting plate 323 is connected with the rear end of the basket placing section 302 via a connecting component 324 fixed on the front side of the connecting plate 323 as well as the bottom surface of the basket placing section 302. Moreover, the lower portion of the pole component 322 at the side of the platform section 202 in the pole component pair 322 is fixed on one side 210*c* of the first housing 210 of the platform section 202 via a connecting component 325.

The bag holder section 303 supported by the support section 320 is arranged on the one side of the structural body 224 of the settlement terminal 201 and located above the basket placing section 302. The cutoff section 313 is arranged at a position behind the first photographing window 221*a* and located over the basket placing section 302. The bag holder section 303 extends forwards from the support section 320 and at least a part thereof is located over the basket placing section 302. The bag holder section 303 is preferably wholly or partially located over the basket placing section 302 and is partially located over the basket placing section 302 in this embodiment. Moreover, a space S (refer to FIG. 4 and FIG. 5) is formed between the bag holder section 303 and the basket placing section 302 to accommodate the basket 305 placed on the basket placing section 302. The bag holder section 303 is located at a high position where the bag holder section 303 does not interfere with a relatively tall bottle even if such a tall bottle is accommodated in the basket 305 placed on the basket placing section 302. In this embodiment, the bag holder section 303 is fixed on the support section 320, however, it is not limited to the above, and the bag holder section 303 may be installed on the support section 320 such that a position thereof in the up and down direction is movable to the support section 320. Moreover, in this embodiment, the support section 320 is exemplarily fixed on the settlement terminal 201, however, it is not limited to the above, and the support section 320 may stand independently but not fixed on the settlement terminal 201.

The adhesive tape holder 304 is arranged on the bag holder section 303. The adhesive tape holder holds an adhesive tape 330, formed in a rolled state, which is able to be pulled out. The adhesive tape holder 304 is equipped with a blade 331 for cutting off the adhesive tape 330 pulled out.

As shown in FIG. 1, a scalepan 403 is arranged on the upper portion of the housing 402 of the weighing device 401. A bag holder 404 and a temporary holding table 406 are arranged on the upper surface of the scalepan 403. The bag holder 404 supports a packaging bag (a second bag) in an opened state. The temporary holding table 406 is a table for temporarily placing the commodity after the code of the commodity is read by the first photographing unit 221 or the second photographing unit 225. A load cell unit (not shown) is arranged in the housing 402 to convert the load of the commodity placed on the scalepan 403 to an electric signal. The output signal of the load cell unit is output to the information processing device of the settlement terminal 201.

A method for using the self checkout terminal 101 with the structure above is described below. A customer places the basket 305 carrying commodities to be purchased on the basket placing section 302. The customer stands in front of the settlement terminal 201, and touches the 'start' button displayed on the display 223. Then, the customer takes out the commodities one by one from the basket 305, and holds the commodity taken out near (photographing area) the first photographing window 221*a* of the first photographing unit 221 to read the commodity code affixed to the commodity using the first photographing unit 221 (photographing operation, scanning operation). Here, a relatively big or heavy commodity is sometimes placed in a shopping cart instead of the basket 305. In this case, the second photographing unit 225 may be taken from the cradle 226, and the second photographing window 225*c* of the second photographing unit 225 is held near the commodity to read the commodity code affixed to the commodity with the second photographing unit 225 (photographing operation, scanning operation). At this time, the information processing device carries out a commodity registration processing to register (store) the commodity with the commodity code that is read.

Next, the customer takes the commodity the commodity code of which is read into the packaging bag supported by the bag holder 404 in an opened state. Meanwhile, the information processing device carries out a well-known weight checking processing using the commodity weight measured by the weighing device 401.

If needed, the customer may take a bag 308 from the bag holder section 303 to take commodities into the bag 308 before the commodity codes are read by the first photographing unit 221. For instance, the customer may take commodities with liquid or water, such as fishes, fruits, etc., into the bag 308. Moreover, the customer may seal, with the cutoff adhesive tape 330, the bag 308 in which the commodities with liquid are packed. Further, the customer may place a commodity easy to be deformed or crushed (e.g. bread) on the temporary holding table 406 after the commodity code of the commodity is read.

After taking the commodities into the packaging bag, the customer touches the 'end' button displayed on the display 223 and puts, for example, an amount of money displayed on the display 223 in cash, into the depositing and dispensing device 211 to settle the payment for the commodities. Then, the customer takes the packaging bag away from the bag holder 404.

As stated above, in this embodiment, the self-checkout terminal 101 is equipped with a first photographing unit 221 and a portable second photographing unit 225, and is therefore more convenient than a self-checkout terminal not equipped with the second photographing unit 225.

Moreover, in this embodiment, as the cradle 226 is arranged on the upper surface 210*b* of the first housing 210 between the extension section 223*b* of the display 223 and the upper surface 210*b* of the first housing 210 serving as the upper surface of the platform section 202, and is opposite to the structural body 224 in the width direction (direction Y) of the structural body 224, the self-checkout terminal 101 is relatively small. Moreover, the interference caused by the cradle 226 and the second photographing unit 225 to the photographing (scanning) operation of the first photographing unit 221 can be restricted.

Moreover, in this embodiment, one end 225*a* of the second photographing unit 225 is provided with the second photographing window 225*c* while the other end 225*d* of the second photographing unit 225 is connected with the curl cord 228, and the cradle 226 supports the second photographing unit 225 in a state in which the other end 225*d* of the second photographing unit positions in front of the one end 225*a*, thus preventing the curl cord 228 from being caught on the cradle 226.

Further, in this embodiment, since the curl cord 228 extends forwards from the front part 226*f* of the cradle 226, the customer can intuitively recognize the position (cradle 226) to which the second photographing unit 225 returns.

Further, in this embodiment, the curl cord accommodation section 210*e* for accommodating the curl cord 228 is arranged on the upper surface 210*b* of the first housing 210 (the upper surface of the platform section), thus preventing the curl cord 228 from hanging from the first housing 210.

Further, in this embodiment, the second photographing unit 225 placed on the cradle 225 is located lower than the receipt issuing port 22*a* (refer to FIG. 2). Such construction reduces the interference between the second photographing unit 225 or the curl cord 228 and the receipt discharged from the receipt issuing port 222*a* when the second photographing unit 225 is returned to the cradle 226.

Further, in this embodiment, since the cradle 226 is formed in a curved shape similar to the second photographing unit 225, the customer can easily recognize the position (cradle 226) to which the second photographing unit 225 returns.

While certain embodiments have been described, these embodiments have been presented by way of example only, and are not intended to limit the scope of the inventions . Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A self-checkout apparatus, comprising:

a structural body including a first photographing unit, provided with a first photographing window at the front part thereof, which has a photographing area in front of the first photographing window, through which the first photographing unit photographs a computer readable symbol in the photographing area;

a portable second photographing unit configured to photograph the computer readable symbol;

a cradle, arranged at a position adjacent to one side of the structural body, on which the second photographing unit is placed;

a display arranged at the upper end part of the structural body; and a platform section on which the structural body is provided, wherein the display has an extension part extending towards the one side of the structural body, and the cradle is arranged on the upper surface of the platform section between the extension part and the upper surface of the platform section and is opposite to the structural body in the width direction of the structural body, and the second photographing unit includes a second photographing window arranged at one end and a cord connected to the other end thereof, and the cradle supports the second photographing unit in a state that the other end of the second photographing unit is positioned in front of the one end thereof, a first insertion hole thorough which the cord is inserted is arranged on a front part of the cradle and the cord extends forward form the front part of the cradle, and the self checkout apparatus further comprises a cord placing section, arranged on the upper surface of the platform section, on which the cord is placed, and a second insertion hole which the cord is inserted is arranged under the cradle on the upper surface of the platform section.

2. The apparatus according to claim 1, further comprising:

a receipt issuing port, configured to issue a receipt, that is arranged on the structural body below the first photographing window, wherein the second photographing unit placed on the cradle is located lower than the receipt issuing port.

* * * * *